United States Patent [19]

Uchida et al.

[11] Patent Number: 4,664,601

[45] Date of Patent: May 12, 1987

[54] OPERATION CONTROL SYSTEM OF ROTARY DISPLACEMENT TYPE VACUUM PUMP

[75] Inventors: Riichi Uchida; Katsumi Matsubara; Seiji Tsuru, all of Ibaraki, Japan

[73] Assignee: Hitachi, Ltd., Tokyo, Japan

[21] Appl. No.: 758,032

[22] Filed: Jul. 23, 1985

[30] Foreign Application Priority Data

Jul. 25, 1984 [JP] Japan ..... 59-152818

[51] Int. Cl.[4] ..... F04B 49/02

[52] U.S. Cl. ..... 417/27; 417/28; 417/45; 417/295

[58] Field of Search ..... 417/26, 27, 45, 295, 417/28

[56] References Cited

U.S. PATENT DOCUMENTS

| | | | |
|---|---|---|---|
| 3,890,063 | 3/1975 | Spafford | 417/27 |
| 4,068,980 | 1/1978 | Fine | 417/27 |
| 4,135,860 | 1/1979 | Van Nederkassel | 417/27 |
| 4,219,312 | 8/1980 | Mori et al. | 417/295 |
| 4,225,288 | 9/1980 | Mugele et al. | 417/28 X |
| 4,492,526 | 1/1985 | Hartwig | 417/45 |
| 4,511,312 | 4/1985 | Hartwig | 417/45 |
| 4,518,316 | 5/1985 | Yokota | 417/45 |

*Primary Examiner*—Carlton R. Croyle
*Assistant Examiner*—Paul F. Neils
*Attorney, Agent, or Firm*—Antonelli, Terry & Wands

[57] ABSTRACT

An operation control system of a rotary displacement type vacuum pump capable of reducing a starting torque of the vacuum pump includes a suction regulating valve and a pressure sensor for monitoring suction pressure located in a suction passage of the vacuum pump, an inverter electrically coupled to a variable speed electric motor for driving the vacuum pump and a control unit. The control unit is operative, when the vacuum pump is started, to keep the suction regulating valve in a closed position until the value of suction pressure monitored by the pressure sensor reaches a predetermined upper limit value and to gradually increase the rpm. of the variable speed electric motor. The control unit is further operative to produce a signal for increasing or decreasing the rpm of the variable speed electric motor so as to bring the value of suction pressure monitored by the pressure sensor to the vicinity of a predetermined lower limit value.

9 Claims, 5 Drawing Figures

OPERATION CONTROL SYSTEM OF ROTARY DISPLACEMENT TYPE VACUUM PUMP

BACKGROUND OF THE INVENTION

This invention relates to an operation control system of a rotary displacement type vacuum pump, such as a screw type vacuum pump, scroll type vacuum pump, and more etc., particularly, to a rotary displacement type vacuum pump which is oil-free.

One type of volume control system of a screw compressor is disclosed in, for example, U.S. Pat. No. 4,219,312 and, while it is not generally known to use this type of screw fluid machine as a vacuum pump, studies have shown that a screw fluid machine serving as a compressor can be used as a vacuum pump.

However, to use a screw fluid machine of the prior art as a vacuum pump, a number of problems must be resolved.

More particularly, vacuum pump raises the pressure of gas which is below $10^{-2}$ Torr to the atmospheric pressure level (760 Torr) before discharging same. Thus, it has a high ratio of suction pressure to discharge pressure, with a result that it has a high volume ratio (the ratio of the volume of the working chamber when suction is finished to the volume of the working chamber when discharge is started). On the other hand, when the machine is started, suction pressure is at the atmospheric pressure level. Thus, a starting torque is high because the machine is started when suction pressure is much higher than when a steadystate operation is performed.

Additionaly, high starting torque makes it necessary to use an electric motor of a capacity which is much greater than the capacity required for the steadystate operation of the machine.

Furthermore, the rpm. of the electric motor for driving the machine is generally constant, so that it is difficult to maintain a predetermined level suction pressure or the pressure in a vessel communicating with the suction side of the machine during the steadystate operation.

SUMMARY OF THE INVENTION

An object of this invention is to provide an operation control system of a rotary displacement type vacuum pump capable of lowering a starting torque of the vacuum pump.

Another object is to provide an operation control system of a rotary displacement type vacuum pump capable of reducing the capacity of a drive motor of the vacuum pump.

The outstanding characteristics of the invention enabling the aforesaid objects to be accomplished include suction regulating valve means including a suction regulating valve located on the suction side of the rotary displacement type vacuum pump, a pressure sensor for monitoring suction pressure located on the suction side of the vacuum pump, an inverter electrically coupled to an electric motor to provide a variable speed motor for driving the vacuum pump, and a control unit connected to the suction regulating valve means, pressure sensor and inverter. The control unit is operative to produce, at startup, a signal to close the suction regulating valve until suction pressure monitored by the pressure sensor reaches a predetermined upper limit value, and a signal to increase the rpm. of the motor gradually (linearly, in the form of a quadric curve or stepwise) after the motor is started at low speed. The control unit is further operative to produce a signal to reduce the rpm. of the motor when the suction pressure monitored by the pressure sensor drops below a predetermined lower limit value, and a signal to increase the rpm. of the motor when the suction pressure rises above the lower limit value, to thereby vary the rpm. of the motor to bring the suction pressure monitored by the pressure sensor to the vicinity of the lower limit value.

DETAILED DESCRIPTION

Figure 1:
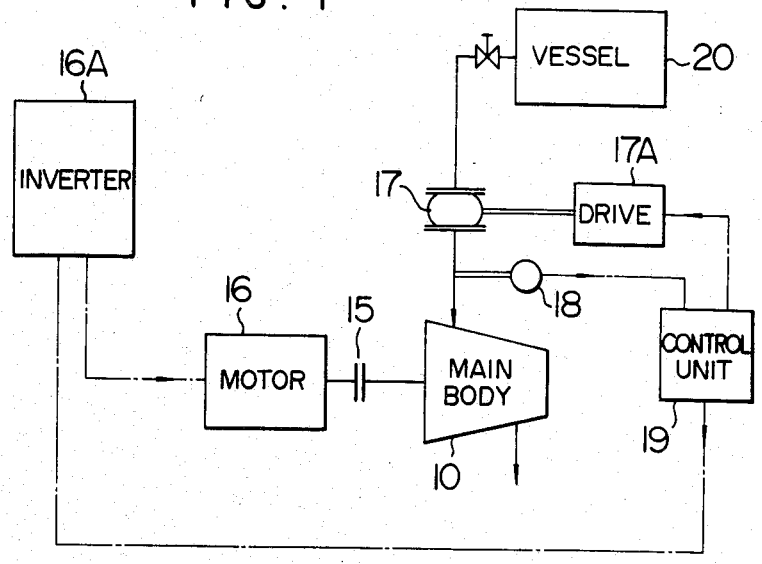
FIG. 1 is a schematic view of one embodiment of the invention.
Figure 2:
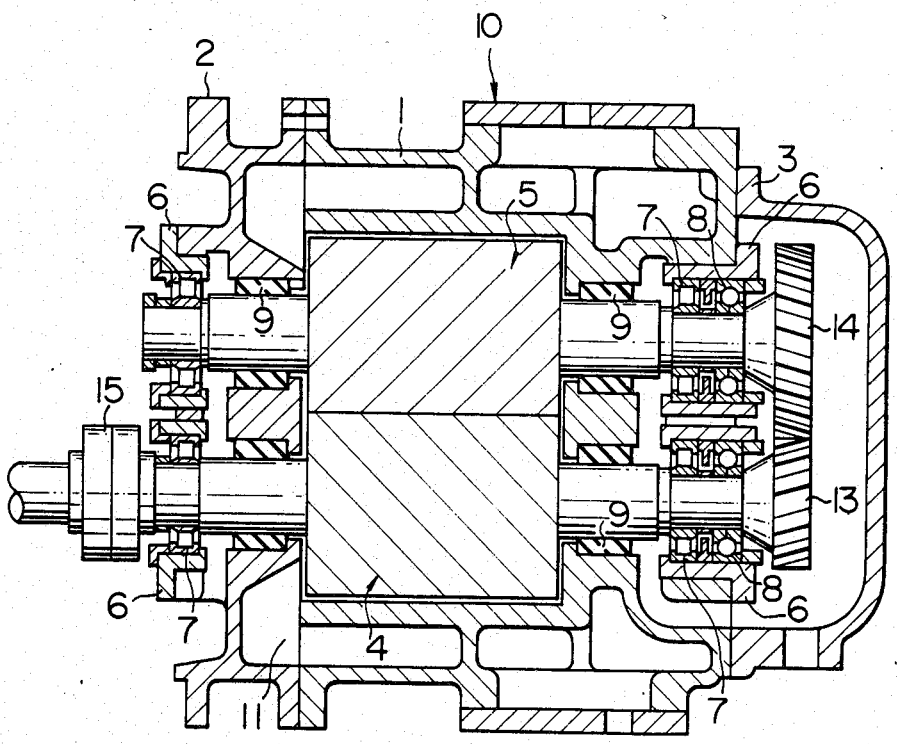
FIG. 2 is a vertical sectional view of a screw type vacuum pump.

As shown in FIG. 2, a vacuum pump, of an oil-free type, comprises a main body 10 including a casing assembly including a main casing 1, a suction-side casing 2 secured to a power input side of the main body 10 and an end cover secured to a side of the main body 10 opposite the power-input side of the main body 10 at which the suction-side casing 2 is secured to the main body 10. A male rotor 4 and a female rotor 5, maintained in an interfitting relationship with a small gap therebetween, are located in the main casing 1 and journalled by bearings 7 mounted in stuffing boxes 6 in an end portion of the main casing 1 and the suction-side casing 2. Ball bearings 8 are provided to maintain the male rotor 4 and female rotor 5 against axial movement. Seals 9 are mounted between rotor shafts and the main casing 1 and suction-side casing 2, to avoid compressed gas in the main casing 1 leaking therefrom and prevent lubricant fed to the bearings 7 and 8 from entering a space for the rotors 4 and 5 in the main casing 1. A high-frequency motor 16, having an inverter 16A coupled thereto, is connected through a coupling 15 to one end of the shaft of the male rotor 4 at which power is inputted to the rotor 4. The inverter 16A may be of the "HFC" series manufactured by Hitachi, Ltd. A male timing gear 13, connected to an opposite end of the shaft of the male rotor 4, is maintained in meshing engagement with a female timing gear 14 which is connected to an end of the shaft of the female rotor 5, to cause the two rotors 4 and 5 to rotate in conjunction with each other while being kept out of contact with each other. A suction passage 11 is formed in the main casing 1 and suction-side casing 2, and a discharge passage, not shown, is formed in the main casing 1.

A suction regulating valve 17 is connected to the suction passage 11 and connected, at its upstream side, to a space or a sealed vessel 20 to be evacuated.

A pressure sensor 18 is mounted to a downstream side of the suction regulating valve 17 to monitor suction pressure.

A control unit 19 of the type disclosed in, for example, Japanese Patent Publication No. 8210/76, is coupled to the pressure sensor 18, suction regulating valve 17 and inverter 16A and produces various signals and supplies the same to the inverter 16A and a drive 17A of the suction regulating valve 17. More specifically, when the vacuum pump is started, the control unit 19 produces an rpm. increment signal which increases the rpm. of the motor 16 with lapse of time until a predetermined upper limit value is reached after the motor 16 is started at a low speed. The control unit 19 produces a full-close signal which fully closes the suction regulating valve 17 from a time the vacuum pump is started to a time at which suction pressure reaches the predetermined upper limit value. The control unit 19 produces an open signal which opens the suction regulating valve 17 when the suction pressure which is following a downward course reaches the predetermined upper limit value. The control unit 19 further produces an rpm. varying signal which increases the rpm. of the motor 16 when the suction pressure exceeds a predetermined lower limit value and which reduces the rpm. of the motor 16 when it drops below the predetermined lower limit value. The rpm. increment signal may be such that the increase in rpm. is linear, in the form of a quadric curve or stepwise, with lapse of time. The suction regulating valve 17 may be of the same construction as described in, for example, U.S. Pat. No. 4,219,312.

Figure 3:
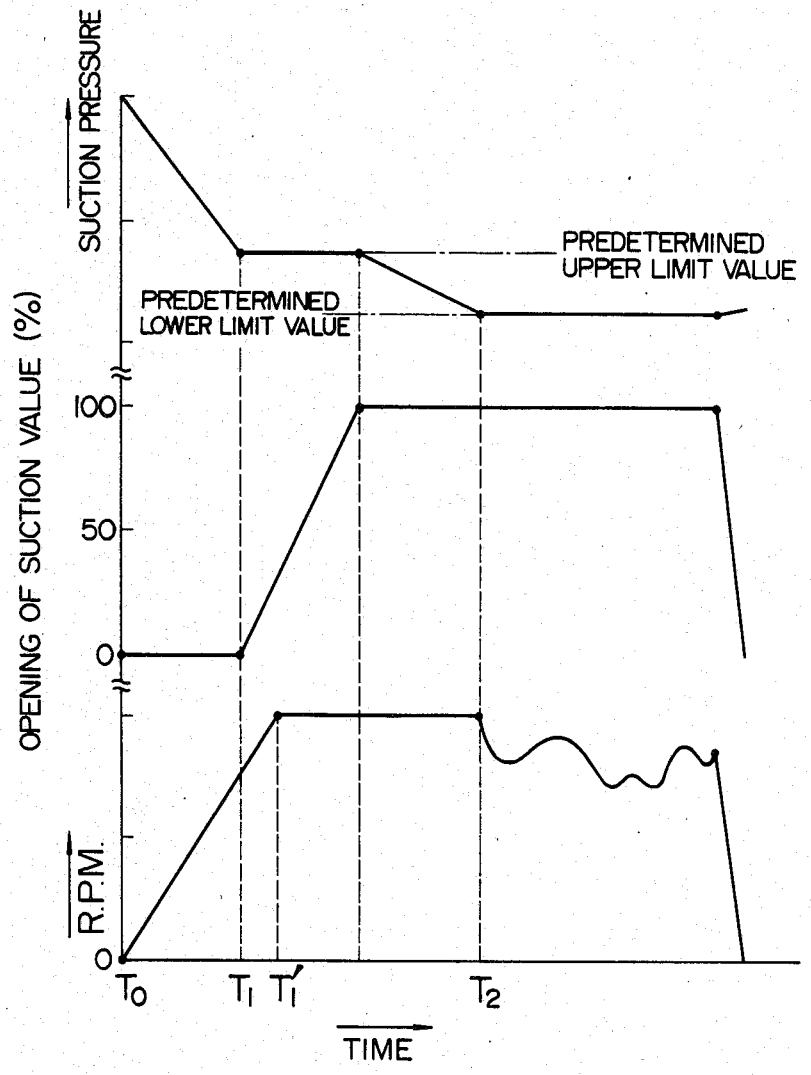
FIG. 3 is a diagram showing the rpm. of the motor, the opening of the suction regulating valve and the suction pressure in relation to the time elapsing after the vacuum pump is started until it is shut down.

The operation of the vacuum pump of the aforesaid construction will now be described by referring to FIG. 3. When the vacuum pump is shut down, the suction regulating valve 17 is fully closed as indicated at To. When the vacuum pump is electrically connected to a power source while the suction regulating valve 17 is in this condition, the control unit 19 produces an rpm. increment signal and supplies the same to the inverter 16A which produces a frequency that is proportional to the voltage, so as to start the high-frequency motor 16 at a low frequency. This causes the vacuum pump to start rotating at a low rpm. As a result, suction pressure between the suction regulating valve 17 and the main body 10 of the vacuum pump drops. When the suction pressure reaches a predetermined upper limit value ($T_1$), the pressure sensor 18 causes the control unit 19 to produce an open signal and supply same to the drive 17A of the suction regulating valve 17, so that the suction regulating valve 17 begins to open to draw gas from the vessel 20 to the main body 10 of the vacuum pump from which it is released to the atmosphere. As the suction pressure reaches a predetermined lower limit value, the control unit 19 produces an rpm. varying signal and supplies same to the inverter 16A, so as to adjust the rpm. of the motor 16 and hence the rpm. of the vacuum pump to bring the suction pressure to the vicinity of the predetermined lower limit level.

In steadystate operation condition, the vacuum pump is operated to bring the suction pressure to a value equal to the predetermined lower limit value, as described hereinabove. When the vacuum pump is shut down, the suction regulating valve 17 is fully closed as the vacuum pump is electrically disconnected from the power source, to avoid a rise in suction pressure which might otherwise be caused to occur by the discharged gas leaking into the suction side.

Figure 4:
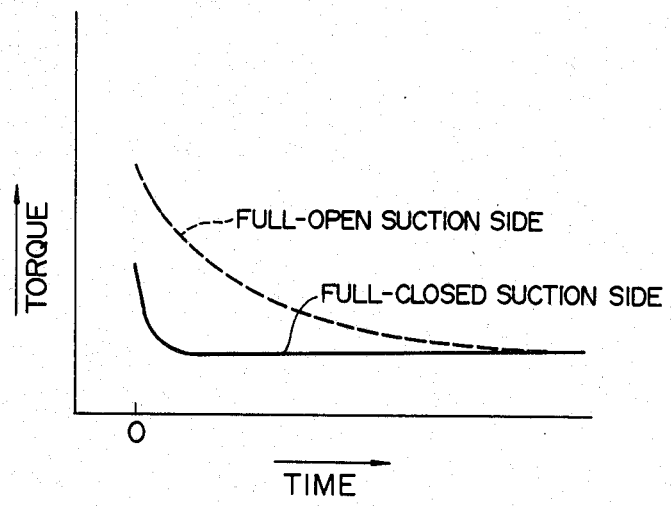
FIG. 4 is a diagram showing the torque in relation to the time elapsing after the vacuum pump is started until it is shut down.

When a screw fluid machine functions as a vacuum pump, a torque in steadystate condition would be much lower than when it functions as a compressor. However, immediately after startup, an internal compression inherent to the screw fluid machine would be produced and the torque at startup would be several times as high as the torque in steadystate condition. FIG. 4 diagrammatically illustrates the relationship between torque and time elapsing after the machine is started. In FIG. 4, a solid line represents the suction side in full-closed condition and a broken line indicates the suction side in full-open condition. In FIG. 4, it will be understood that the screw fluid machine according to the invention which is started while keeping the suction side in full-closed condition is capable of reducing the starting torque.

Figure 5:
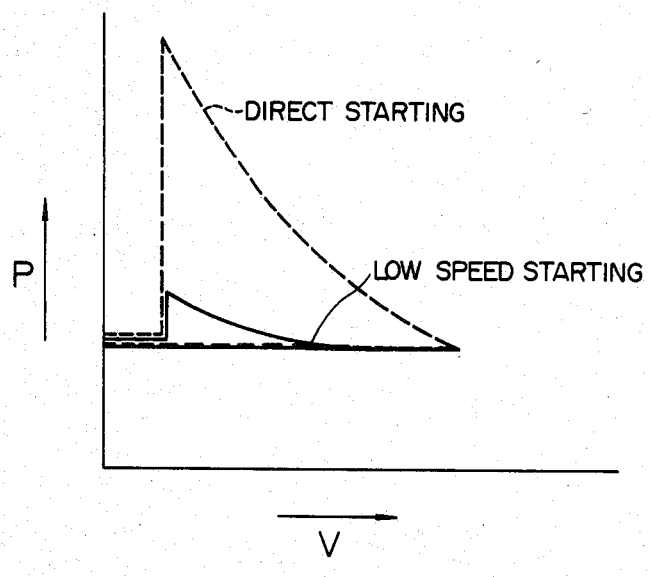
FIG. 5 is a P-V diagram obtained at vacuum pump startup.

FIG. 5 shows a P-V diagram obtained at startup. In FIG. 5, a broken line represents direct starting and a solid line indicates starting at low frequency. It will be seen that, when the machine is started at low frequency (low speed), there is almost no rise in pressure and, consequently, the starting torque is low.

What is claimed is:

1. An operation control system of a rotary displacement type vacuum pump, comprising:

suction regulating valve means in a suction passage of the rotary displacement type vacuum pump;

a pressure sensor in said suction passage of the rotary displacement type vacuum pump, said pressure sensor being located downstream of said suction regulating valve means;

a variable speed electric motor connected to the rotary displacement type vacuum pump;

inverter means electrically coupled to said variable speed electric motor; and a control unit operatively connected to said suction regulating valve means, pressure sensor and inverter means, said control unit producing a full-close signal and an rpm increment signal when the rotary displacement type vacuum pump is started, said full-close signal being supplied to said suction regulating valve means to keep a suction regulating valve of said suction regulating valve means in a full-closed position until the value of suction pressure monitored by said pressure sensor reaches a predetermined upper limit value and said rpm increment signal being supplied to said inverter means to increase the rpm of said variable speed electric motor with time after the motor is started at low speed, said control unit further producing an open signal and an rpm increasing and decreasing signal when the value of suction pressure monitored by said pressure sensor has reached the predetermined upper limit value, said open signal being supplied to said suction regulating valve means to open said suction regulating valve of the suction regulating valve means and said rpm increasing and decreasing signal being supplied to said inverter means to increase or decrease the rpm of said variable speed electric motor to bring the value of suction pressure monitored by said pressure sensor to the vicinity of a predetermined lower limit value.

2. An operation control system of a rotary displacement type vacuum pump as claimed in claim 1, wherein said rpm is continuously produced after the value of suction pressure monitored by said pressure sensor has reached the predetermined upper limit value.

3. An operation control system of a rotary displacement type vacuum pump as claimed in claim 1, wherein said rpm increment signal increases the rpm substantially at a constant rate.

4. An operation control system of a rotary displacement type vacuum pump as claimed in claim 1, wherein said open signal supplied to said suction regulating valve means increases the opening of said suction regulating valve substantially at a constant rate.

5. An operation control system of a rotary displacement type vacuum pump as claimed in claim 1, wherein said control unit produces, when the value of suction pressure monitored by said pressure sensor is between said upper limit value and lower limit value, a signal to rotate said variable speed electric motor at an upper limit rpm and supplies said signal to said inverter means.

6. An operation control system of a screw vacuum pump comprising:

suction regulating valve means in a suction passage of the screw vacuum pump;

a pressure sensor in said suction passage of the screw vacuum pump, said pressure sensor being located downstream of said suction regulating valve means;

a variable speed electric motor connected to the screw vacuum pump;

inverter means electrically coupled to said variable speed electric motor; and a control unit operatively connected to said suction regulating valve means, pressure sensor and inverter means, said control unit producing a full-close signal and an rpm increment signal when the screw vacuum pump is started, said full-close signal being supplied to said suction regulating valve means to keep a suction regulating valve of said suction regulating valve means in a full-closed position until the value of suction pressure monitored by said pressure sensor reaches a predetermined upper limit value and said rpm increment signal being supplied to said inverter means to increase the rpm of said variable speed electric motor with time after the motor is started at low speed, said control unit further producing an open signal and an rpm increasing and decreasing signal when the value of suction pressure monitored by said pressure sensor has reached the predetermined upper limit value, said open signal being supplied to said suction regulating valve means to open said suction regulating valve of the suction regulating valve means and said rpm increasing and decreasing signal being supplied to said inverter means to increase or decrease the rpm of said variable speed electric motor to bring the value of suction pressure monitored by said pressure sensor to the vicinity of a predetermined lower limit valve.

7. An operation control system of a screw vacuum pump as claimed in claim 6, wherein said rpm increment signal increases the rpm substantially at a constant rate.

8. An operation control system of a screw vacuum pump as claimed in claim 6, wherein said open signal supplied to said suction regulating valve means increases the opening of said suction regulating valve substantially at a constant rate.

9. An operation control system of a screw vacuum pump as claimed in claim 6, wherein said control unit produces, when the value of suction pressure monitored by said pressure sensor is between said upper limit value and lower limit value, a signal to rotate said variable speed electric motor at an upper limit rpm and supplies said signal to said inverter means.

* * * * *